US005328568A

United States Patent [19]

Pregont

[11] Patent Number: 5,328,568

[45] Date of Patent: Jul. 12, 1994

[54] METHOD AND APPARATUS FOR MANUFACTURE OF FREE-FLOWING DUNNAGE OF MOLDED PULP

[75] Inventor: Jack E. Pregont, Janesville, Wis.

[73] Assignee: Pulptech Corporation, Janesville, Wis.

[21] Appl. No.: 979,799

[22] Filed: Nov. 20, 1992

Related U.S. Application Data

[63] Continuation of Ser. No. 800,281, Nov. 29, 1991, Pat. No. 5,230,943.

[51] Int. Cl.[5] ..... D21J 1/06

[52] U.S. Cl. ..... 162/226; 162/230; 162/228

[58] Field of Search ..... 162/226, 228, 230, 382, 162/388, 389, 410; 206/584, 814; 119/172, 171; 264/86, 87

[56] References Cited

U.S. PATENT DOCUMENTS

| | | | |
|---|---|---|---|
| 1,284,928 | 11/1918 | Raymond . | |
| 1,527,201 | 2/1925 | Louisot . | |
| 1,574,124 | 2/1926 | Sherwood | 162/230 |
| 1,661,727 | 3/1928 | Koppelman et al. . | |
| 1,701,238 | 2/1929 | Kennedy . | |
| 1,796,794 | 3/1931 | Koppelman | 162/231 |
| 1,845,830 | 2/1932 | Chaplin | 162/224 |
| 1,859,325 | 5/1932 | Ayerst . | |
| 1,899,197 | 2/1933 | Huff et al. . | |
| 1,907,795 | 5/1933 | Hall . | |
| 2,182,274 | 12/1939 | Baker et al. | 92/54 |
| 2,663,230 | 12/1953 | Wagner | 92/57 |
| 2,703,041 | 3/1955 | Comstock | 92/56 |
| 2,955,975 | 10/1960 | Richardson | 162/199 |
| 3,185,370 | 5/1965 | Reifers et al. | 229/2.5 |
| 3,306,813 | 2/1967 | Reifers | 162/223 |
| 3,320,120 | 5/1967 | Randall | 162/391 |
| 3,401,079 | 9/1968 | Wells | 162/219 |
| 3,606,726 | 9/1971 | Spertus et al. | 53/28 |
| 3,613,522 | 10/1971 | Johnson et al. | 93/1 WZ |
| 3,650,877 | 3/1972 | Johnson | 161/47 |
| 3,661,707 | 5/1972 | Emery et al. | 162/392 |
| 3,723,240 | 3/1973 | Skochdopole et al. | 161/173 |
| 3,802,963 | 4/1974 | Lee et al. | 162/228 |
| 3,855,053 | 12/1974 | Fuss | 161/168 |
| 3,929,564 | 12/1975 | Reifers | 162/224 |
| 3,933,959 | 1/1976 | Skochdopole et al. | 264/45.5 |
| 4,109,040 | 8/1978 | Ottaviano | 428/129 |
| 4,152,203 | 5/1979 | Lord | 162/228 |
| 4,806,410 | 2/1989 | Armington | 428/126 |
| 4,839,210 | 6/1989 | Komaransky | 428/77 |
| 4,937,131 | 6/1990 | Baldacci et al. | 428/131 |
| 4,994,148 | 2/1991 | Shetka | 162/227 |
| 4,997,091 | 3/1991 | McCrea | 206/584 |

FOREIGN PATENT DOCUMENTS 9117932 11/1991 PCT Int'l Appl. .

OTHER PUBLICATIONS

Use and Testing of Free-Flowing Cushioning, by Arthur Graham Modern Packaging Magazine, Jul. 1971.

Emery International Developments, Ltd.—Pulp Molding Equipment Brochure.

*Primary Examiner*—W. Gary Jones
*Assistant Examiner*—Brenda Lamb
*Attorney, Agent, or Firm*—Jansson & Shupe, Ltd.

[57] ABSTRACT

Free-flowing dunnage of molded pulp pieces (10), having random non-nestable shapes to insure the free-flowing characteristic, is made by a method and apparatus involving partially drying pulp fibers on a forming-die screen (38) to form intermediate dish-shaped pieces, form-free removal of such pieces from the screen, and thereafter drying them free of form support to obtain random shapes. One preferred embodiment involves blowing intermediate pieces from the screen onto a conveyor (50) for subsequent drying, such blowing and landing altering the intermediate piece shapes to enhance randomness in the shapes of the dunnage pieces, and another involves using heated air for partial drying.

18 Claims, 6 Drawing Sheets

METHOD AND APPARATUS FOR MANUFACTURE OF FREE-FLOWING DUNNAGE OF MOLDED PULP

RELATED APPLICATION

This is a division in part of patent application Ser. No. 800,281 of Jack E. Pregont, filed Nov. 29, 1991, entitled "Free-Flowing Dunnage of Molded Pulp," now U.S. Pat. No. 5,230,943, issued Dec. 22, 1993.

FIELD OF THE INVENTION

This invention is related generally to material used for packaging, or dunnage, and, more particularly, to free-flowing dunnage materials and methods and apparatus for their manufacture.

BACKGROUND OF THE INVENTION

Free-flowing packaging materials, or "dunnage" or "loose fill" as otherwise known, involve pieces varying greatly in size and shape. That is, some free-flowing dunnages are pieces shaped like peanut shells, while others are rings and still others are other dish-shaped pieces. Whatever the form and material used, the quality of any free-flowing dunnage for packaging purposes is dependent on certain characteristics.

Among the desirable qualities in any free-flowing dunnage material are structural strength, low density and volume maintenance. Ideally the material should also be light in weight, easy to use, versatile for use with any packaged product or with any type of container, non-settling, reusable and static-free, and should prevent movement of products packed within a container and contact between a product's surfaces and interior surfaces of the container.

Foamed plastic materials have dominated the market for free-flowing dunnage, and are made in pieces of various shapes and sizes. Free-flowing dunnage of foamed plastic tends to be light in weight but also tends to have certain disadvantages in handling, such as excessive static problems. Furthermore, environmental concerns have raised considerable questions regarding the use of foamed plastic as a dunnage material, given that plastics which have been used are not biodegradable.

There are many examples of inventions involving plastic free-flowing dunnage, including those disclosed in the following United States patents: U.S. Pat. No. 3,723,240 (Skochdopole et al.), U.S. Pat. No. 3,855,053 (Fuss), and U.S. Pat. No. 3,933,959 (Skochdopole et al.). While free-flowing dunnage of plastic has been most widely used, there are prior disclosures of free-flowing dunnage of other materials, including materials involving use of pulp fiber. However, despite the disadvantages and concerns of using foamed plastic as a free-flowing dunnage material, foamed plastic has continued to dominate in this field.

Among prior disclosures showing use of pulp fiber are U.S. Pat. No. 4,997,091 (McCrea), which teaches manufacture of free-flowing pulp dunnage by extruding pieces of paper fiber and allowing them to dry into solid shapes. However, this material, while it is biodegradable, is disadvantageous in that the heavy weight of solid extruded pulp pieces tends to increase shipping costs unacceptably.

Molded pulp has been used to make containers and other form packaging such as egg cartons and the like. The manufacturing process for such packaging is distinct from the inventions disclosed and claimed herein. And, the molded pulp pieces formed by the method and apparatus of this invention are distinct from anything in the prior art, and form a unique free-flowing pulp fiber dunnage.

Methods for forming molded pulp pieces of the prior art typically include the following steps: First, fiber (such as waste paper) and water are mixed together to produce a pulp slurry. Forming dies are then immersed in the pulp slurry and a vacuum system causes the deposit of pulp fibers thereon. Each forming die includes a screen of suitable mesh such that water of the slurry will be drawn through it leaving a matt of pulp fibers on the screen. A puff of air from the forming die and a vacuum in a transfer die, which mates with the forming die, gently cause the wet formed products to lift off the mold and onto the transfer die. The wet formed products, which typically include about 70–75% water at this stage, are then gently deposited on a conveyor which takes them through a drying oven where hot air is employed to evaporate most of the remaining water content. This process creates molded pulp products which are hollow and generally uniform in shape and size. Such uniformity enables the products to nest with one another, although in some instances molded features may be included to limit or minimize nesting. Published PCT Application WO 91/17932 (Baker et al.), for example, discloses a flowing dunnage made of formed pieces of molded pulp, and discloses the use of particular molded features to limit nesting.

The nesting tendency of molded pulp products is recognized in the Baker et al. disclosure as a particular disadvantage for this sort of dunnage.

Nesting of such dunnage tends to cause loss of volume maintenance within a shipping container filled with such dunnage, thereby providing less effective packaging protection. Nesting also tends to increase the weight-to-volume ratio. Perhaps most significantly, nesting is directly contrary to the free-flowing characteristic which is so essential for such dunnage, which cannot be conveniently used if it is jammed, for example, in an overhead dispensing site.

Methods for making molded pulp products, an old art, vary. Among the variations is that in some cases oven drying is carried out on die-like forms, while in others it is not. In either case, however, mating transfer dies are typically used for transfer of separate, still-moist molded pulp forms from their forming dies to the conveyor for drying. The prior art even recognizes that free-form drying of pulp products can result in significant warpage. See, for example, U.S. Pat. No. 3,185,370 (Reifers et al.). But such warpage effect is viewed as a substantial disadvantage in product manufacture. The prior art does not disclose formation of randomly-shaped edges and voids on a warped product or use of randomness of shape to advantage.

Some comments concerning a variety of other prior art may be appropriate before turning to the invention, even though none of such prior art is considered particularly relevant to the invention disclosed and claimed herein and none of such prior art either discloses or in any way suggests the claimed invention or any significant part of the invention. The disclosures include:

Group A 1,284,928 (Raymond)
1,527,201 (Louisot)

1,661,727 (Koppelman et al.)
1,701,238 (Kennedy)
1,899,197 (Huff et al. )

Group B 3,185,370 (Reifers et al.)
3,306,813 (Reifers)
3,929,564 (Reifers)

Group C 4,997,091 (McCrea)
3,606,726 (Spertus et al. )
Modern Packaging article of July 1971, by Graham Group D 2,663,230 (Wagner)
2,703,041 (Comstock)
3,320,120 (Randall)
3,661,707 (Emery et al.)

Group E 1,859,325 (Ayerst)
1,907,795 (Hall)
2,955,975 (Richardson)
4,994,148 (Shetka)
Emery Pulp Molding Equipment Brochure Group F 3,650,877 (Johnson)
3,613,522 (Johnson et al.)
4,937,131 (Baldacci et al.)
2,182,274 (Baker et al.)
4,109,040 (Ottaviano)
4,806,410 (Armington et al.)
4,839,210 (Komaransky et al.)

Group G 3,723,240 (Skochdopole et al.)
3,855,053 (Fuss)
3,933,959 (Skochdopole et al.).

The Group A patents disclose the concept of air release of molded fiber products from their molding screens. The Koppelman et al. patent uses squeezing dies to help remove liquid from the screened material; the pieces being formed are not separate, but instead are interconnected by a continuous web during oven drying. The Louisot patent utilizes pulsating air impacts to help remove the molded member from the screen. The Kennedy, Raymond, and Huff et al. disclosures all involve removal of completed, dried products from their forming dies. None of the patents of Group A relates to free-flowing dunnage. Furthermore, there is no teaching in any of these patents of randomly-shaped edge formation or randomly-shaped hollowed surfaces.

The patents of Group B are interesting in that each of them refers to warpage in pulp-molding processes. The Reifers et al. '370 patent, already mentioned, provides a good general description of various pulp-molding methods. The Reifers '813 patent refers to the problems of rough edges associated with flashing in molded pulp products. In column 3, beginning at line 40 or so, there is reference to problems associated with air release from the mold—that is, deformation problems. The Reifers '564 patent also refers to warpage as a problem and finds ways to address such problem. The patent notes that products with warpage can in some cases be tolerated, but does not recognize that advantageous use can be made of such warpage.

The two Group C patents relate to free-flowing dunnage made using waste paper. McCrea's free-flowing dunnage, mentioned above, is made only from paper fibers. The Spertus et al. patent discloses dunnage which can be made in a free-flowing form or in a unitary pad-like form, depending on whether little sausage-like pieces are separated one from another. The sausage-like pieces have plastic casings enclosing comminuted waste paper. The Spertus et al. patent uses waste paper in manufacturing free-flowing dunnage. The Graham article refers to "short spiral-wound paper cylinders" which were the "first effective free-flowing cushioning material," but does not disclose a molded pulp product.

The patents of Group D show pulp-molding processes using transfer dies. The Randall patent refers to warping as a problem. None of these patents deals with free-flowing dunnage.

Group E is a miscellaneous collection of other disclosures relating to pulp molding. The Group F patents describe dunnage products made from paper, but relate to pads, not free-flowing dunnage. The Group G patents relate to free-flowing plastic dunnage.

OBJECTS OF THE INVENTION

It is an object of this invention to provide a improved method and apparatus for manufacture of an inexpensive and light, but effective, dunnage material made of molded pulp.

Another object of this invention is to provide a biodegradable dunnage material, which is also non-static.

Another object of this invention is to provide a dunnage material of molded pulp which will maintain its volume and will not nest.

Another object of this invention is to provide a method and apparatus for low-cost manufacture of a high volume of free-flowing molded pulp dunnage having a high degree of randomness in shape to insure the free-flowing characteristic.

These and other important objects will be apparent from the descriptions of this invention which follow.

SUMMARY OF THE INVENTION

The need for a biodegradable, non-static and lightweight dunnage product is fulfilled by the present invention which involves a method and apparatus for manufacture of a free-flowing dunnage product. The free-flowing dunnage made by the method and apparatus of this invention overcomes certain well-known disadvantages of plastic materials and other prior dunnage products.

The invention is based in part on the discovery that warpage of molded pulp pieces during free-of-form drying, rather than being a disadvantage to be avoided, can be harnessed to advantage. This warpage upon drying carried out free of form-mounting results in random shaping of each piece, which prevents the pieces from nesting with one another. Preferred forms of the invention also involve enhancing randomness in shapes by the manner in which intermediate (partially-dry) dish-shaped pieces are removed from the screen on which they are formed.

The method of this invention includes the following steps: mixing pulp fibers with water to form a water-based pulp-stock slurry; capturing damp pulp fibers from the slurry onto shaped screen die-sites; partially drying the pulp fibers on the screen, preferably by through-drying (i.e., by drawing air through the moist pulp on the screen), to form intermediate dish-shaped pieces; form-free removal (i.e., without any transfer dies), of the partially-dried intermediate pieces from the screen; and thereafter drying intermediate pieces free of form support. This method forms randomly-shaped hollow dome-shaped (i.e., dish-shaped) dunnage pieces which resist nesting. The die-sites form intermediate piece shapes—whether like peanut or other nut shells or another hollow dome shape—before removal from the screen; randomness of shapes occurs by virtue of the subsequent steps.

In highly preferred embodiments of this invention, the pulp fibers used to make such molded pulp dunnage are derived from recycled pulp. It is most preferred that the recycled pulp be newsprint.

Intermediate pieces are preferably removed from the screen by blowing. Such blowing preferably causes the intermediate pieces to land on a conveyor, preferably by gravity, for movement to final drying. Such blowing and landing serve to alter intermediate piece shapes and enhance randomness in the shapes of the dunnage pieces. The blowing can cause accelerated movement of pieces to increase the impact of such pieces against the conveyor, or against another surface before the pieces fall onto the conveyor. The nature of such impact can be controlled, and this serves to control the extent of shape alteration of the intermediate pieces.

The combination of (1) partial drying on the screen and (2) later form-free final drying allows fine-tuning of the degree of crushability. It also allows, whenever appropriate, curing of curable agents included in the slurry for any reason. The extent of moisture remaining after partial drying has a bearing on the extent of randomness in final dunnage piece shapes. The distortion brought by blowing and landing of intermediate pieces enhances the degree of randomness in the final product.

Partial drying preferably leaves about 50–70% moisture content in the partially-dried intermediate pieces. Within this range, a greater amount of remaining moisture tends to allow a greater degree of randomness in the shapes of the final dunnage pieces, and a lower amount of moisture tends to control the extent of randomness of shapes. Levels of remaining moisture below this range tend to result in little or no useful shape variation, while levels of remaining moisture above such range tend to result in severe loss of form, which yields dunnage tending to be too dense. Most preferably, partial drying will leave about 60–65% moisture content in the intermediate pieces.

The screen on which the intermediate pieces are formed preferably overlies a backing plate which with the screen determines shapes of the intermediate pieces. The screen and backing plate form a plurality of die-sites, preferably cavities, to form a plurality of pieces. Such backing plate preferably includes a plurality of apertures through which the blowing occurs for form-free removal of the intermediate pieces from the screen.

In preferred embodiments, through-drying as referred to above is carried out by means of a vacuum draw using the same apertures as used for removal from the screen by blowing. Such apertures are preferably also used for drawing the slurry to load the screen.

The apparatus of this invention includes: a backing plate and a screen overlying such backing plate together forming a plurality of die-sites, preferably cavities, shaped for dunnage pieces; means to capture damp pulp fibers on the screen at the die-sites; means to partially dry the pulp fibers on the screen to form intermediate dish-shaped pieces; form-free means for removing the partially-dried intermediate pieces from the screen to positions free of form support; and means to dry the intermediate pieces free of form support.

Certain preferred embodiments include blowing means for removal of intermediate pieces from the screen and a conveyor positioned to receive the intermediate pieces blown from the screen. Such blowing means preferably includes a plurality of apertures through which such blowing occurs to remove the intermediate pieces, such blowing and landing of intermediate pieces on the conveyor altering the shapes of the pieces to enhance the randomness of shapes in the final product.

In certain other preferred embodiments the means for partial drying includes vacuum means for drawing air through the damp pulp fibers, the screen, and the same apertures as are used for blowing. Most preferably, the means for partial drying also includes means to heat the air adjacent to the screen, such that heated air is drawn to speed the partial drying process.

Further details of the apparatus have been described above with respect to the method of this invention.

DETAILED DESCRIPTIONS OF THE PREFERRED EMBODIMENTS

Molded pulp dunnage made using the method and apparatus of this invention has desirable characteristics of structural strength and low density. The product is also readily flowable, so that the dunnage pieces can easily be poured into a container around the object to be protected, filling in the spaces around the object to cushion the object during transport or storage.

Figure 2:
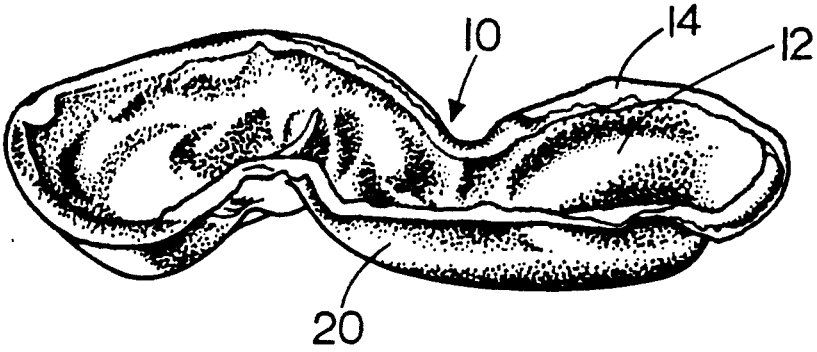
FIG. 2 is an enlarged perspective view of a single piece of such molded pulp dunnage.

One preferred product of the method and apparatus of the invention is a randomly-shaped, peanut-shell-sized hollowed piece 10 of molded pulp dunnage, as depicted in FIG. 2. A wide variety of other dish-shaped shapes and sizes are possible. Dunnage pieces 10 are nonplanar, dish-like and irregular shapes each having a hollowed surface 20 which forms a central void 12 and terminates in an edge 14, which is preferably beaded (as shown).

As indicated by FIG. 2, the cross-dimensional shape of each piece 10 varies along the length thereof due to the random shaping of pieces 10 caused by manufacture pursuant to this invention. Additionally, with respect to at least one lateral cross-section of each piece of the free-flowing molded pulp dunnage shown, the cross-dimensional space between the edges defining central void 12 is less than the cross-dimensional space at the widest part of void 12, making it essentially impossible for the pieces to nest in one another. This lack of nesting capability results in maintenance of the necessary volume in a package to provide the desired protection for the packaged item. The beaded edges 14 formed on each piece lend strength to each dunnage piece to help maintain each respective shape.

As pieces 10 dry freely and without restriction, edges 14 and hollowed surfaces 20 warp, resulting in the random contortion of each piece 10 into a nonplanar, dish-like and irregular shape. Furthermore, upon drying, each piece 10 develops rigidity in shape, although the pulp material is soft enough to provide cushioning.

Figure 4:
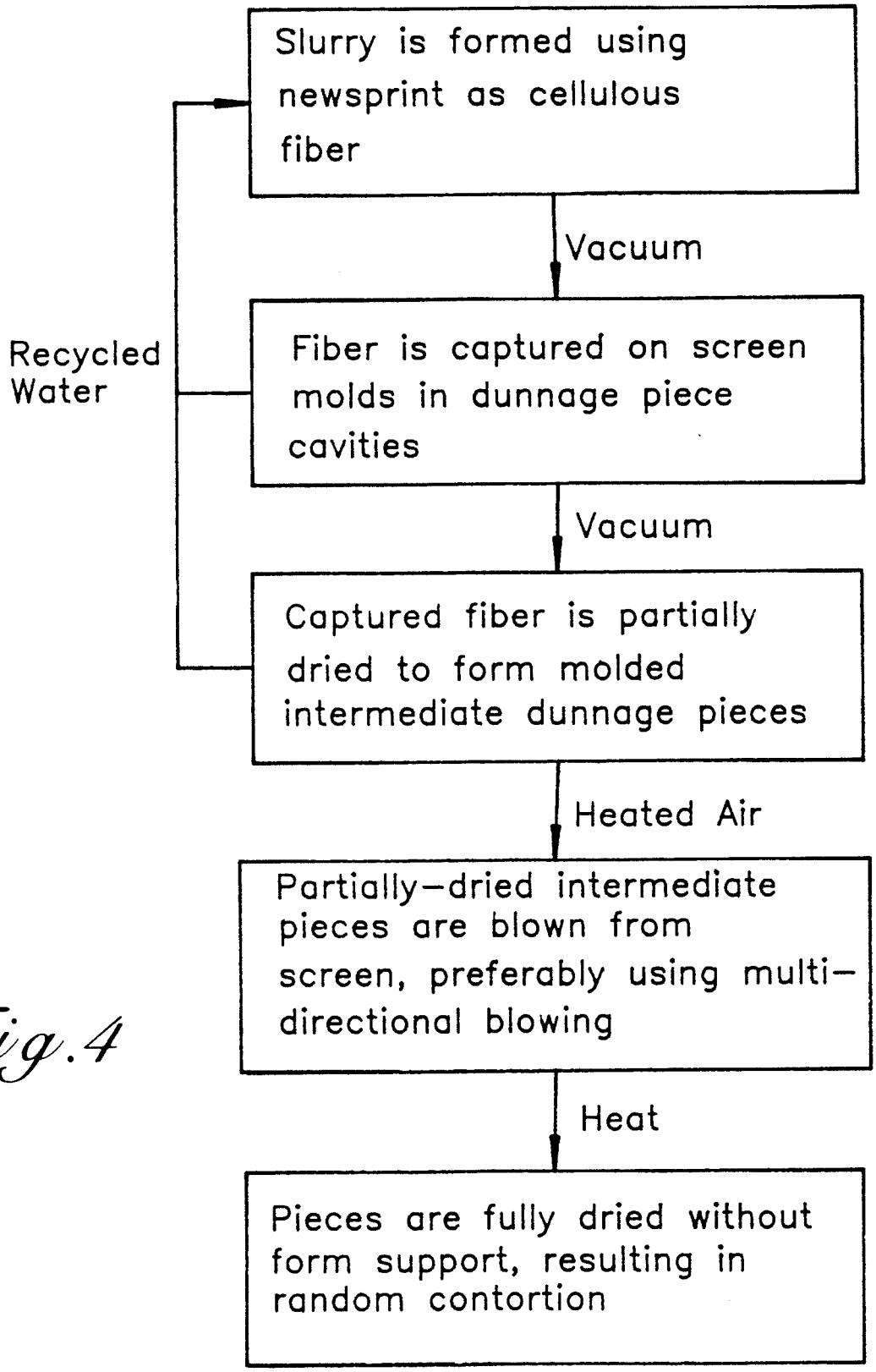
FIG. 4 is a flow chart of the process used to manufacture the molded pulp dunnage.

FIG. 4 provides a summary of the major process steps. The method of this invention involves first mixing, in pulper 32 (see FIG. 5), pulp fibers with water and aluminum sulfate to form a slurry. One example would involve a mixture of water and pulp to yield about a 0.3–2.0% solid consistency, preferably about 0.5–1.5%. The slurry can be supplemented with product conditioners, such as rosin and wax, or other additives for drainage aids or for sizing and wet strength, as deemed desirable to enhance performance of finished product. Formation of pulp slurries is well-known in the industry. It is contemplated that any of the formulas for making pulp slurries could be used in the making of this invention, although it is highly preferred to use recycled pulp in making the slurry, most preferably using newsprint.

Figure 3:
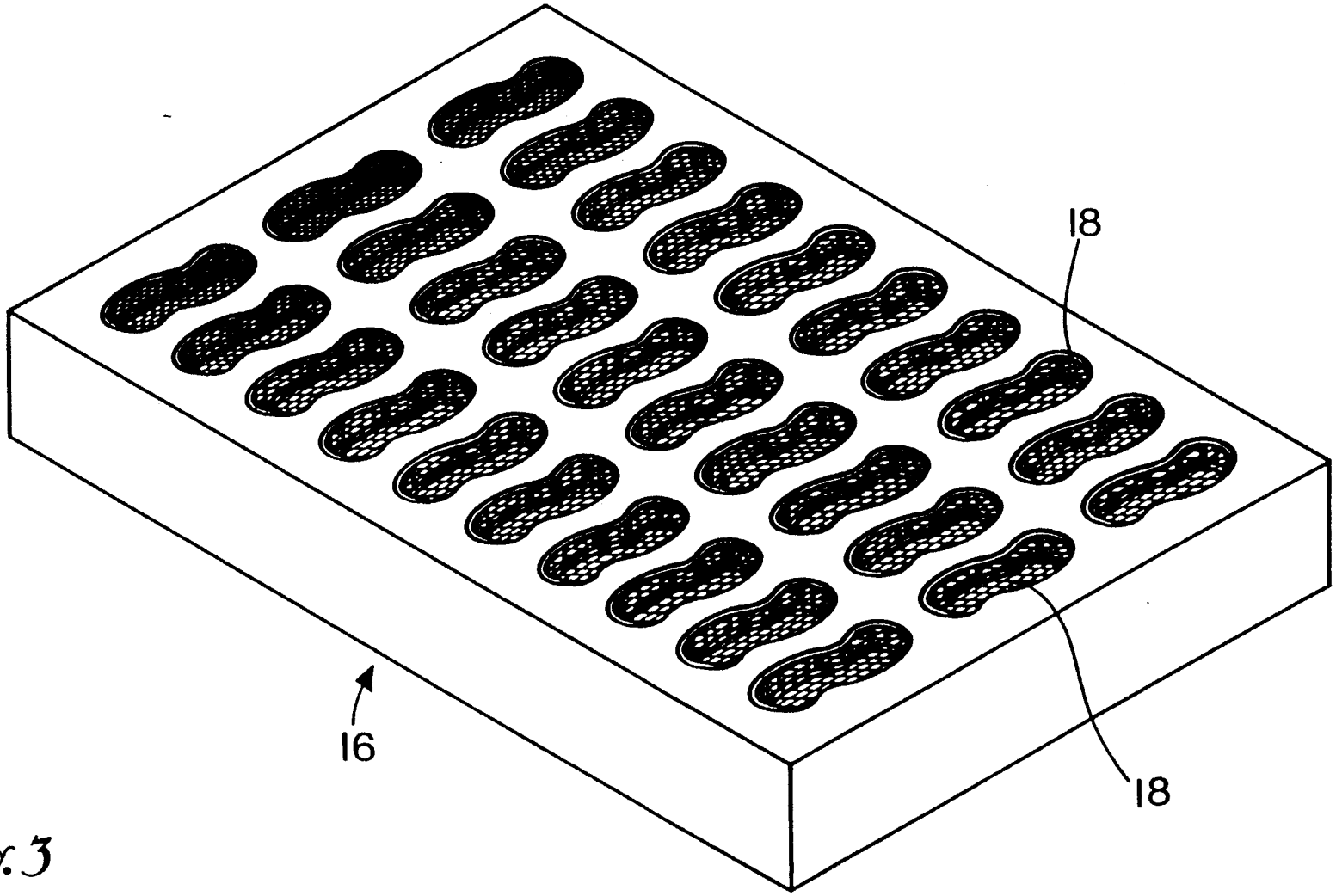
FIG. 3 is a perspective view of the screen mold (forming die) on which the molded pulp collects to form the intermediate dunnage pieces, before final drying.
Figure 5:
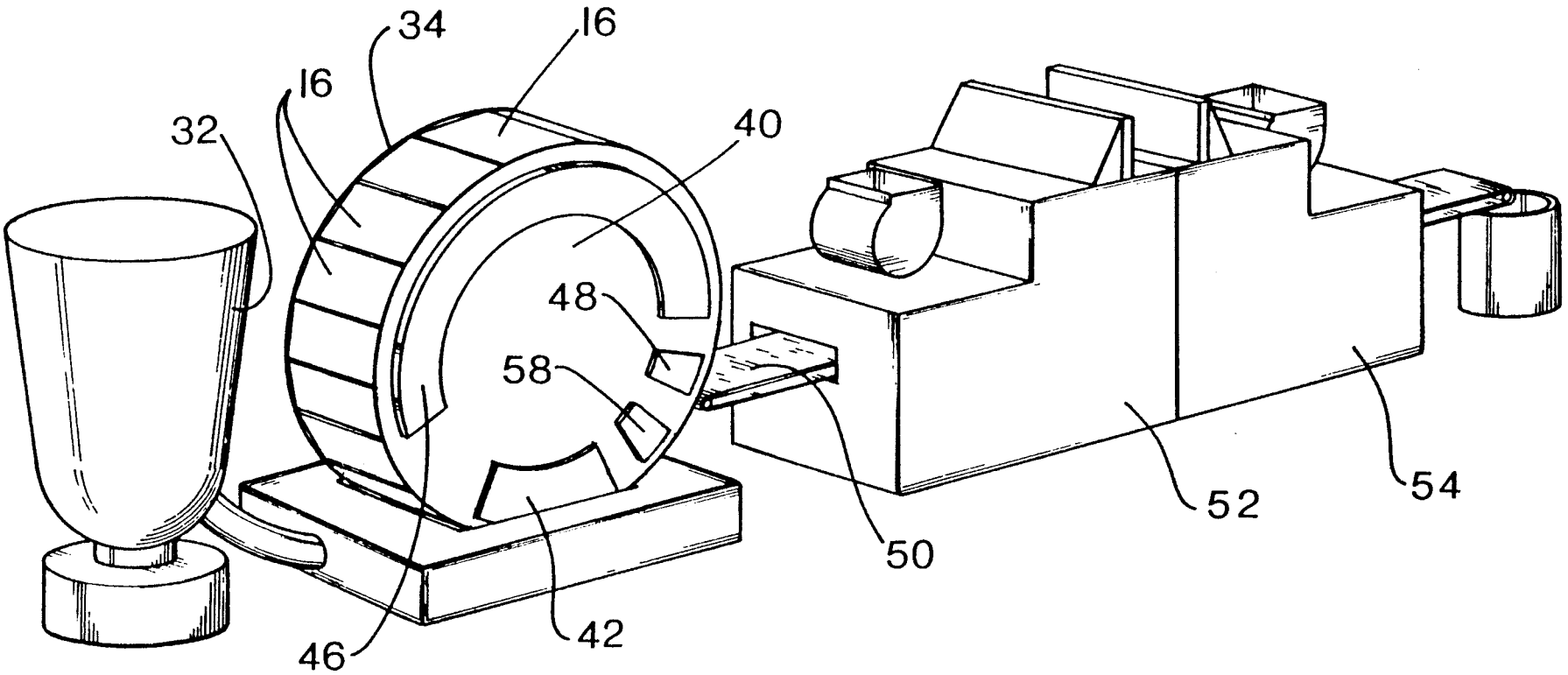
FIG. 5 is a partially schematic perspective view of the apparatus of this invention with certain portions removed, as hereafter noted.
Figure 6:
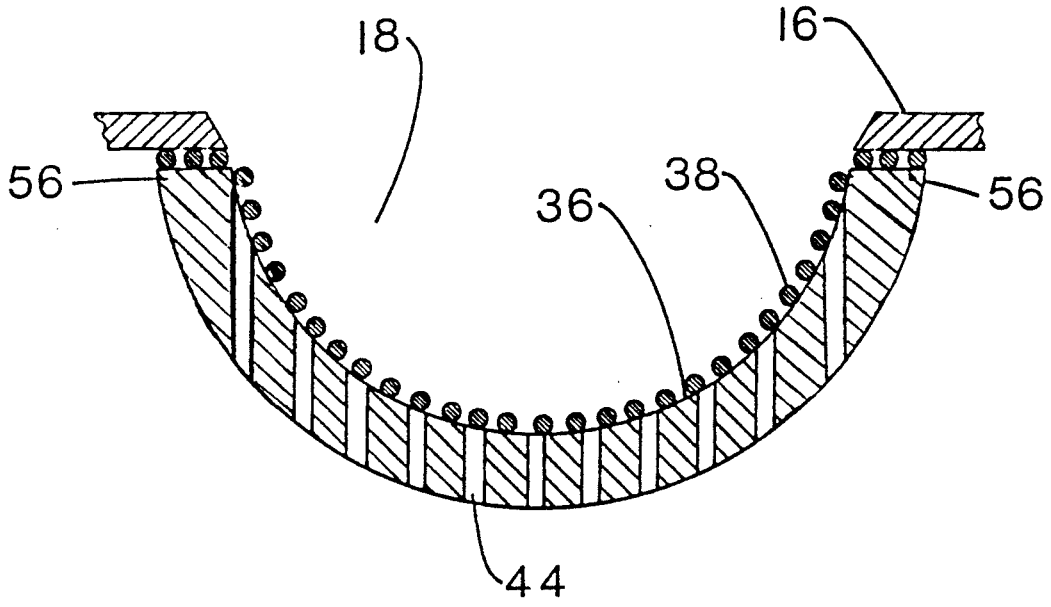
FIG. 6 is an enlarged sectional view (without background) of a single cavity formed by the backing plate and overlying screen.

The slurry is then passed through a mold 16 (forming die) having multiple cavities 18, as depicted in FIG. 3. Several multi-cavity molds 16 are placed around a rotating molder structure 34, as shown in FIG. 5 (without detail). Cavities 18 are formed by a backing plate 36 and a screen 38 which overlies it, as illustrated best in FIG. 6. Cavities 18 are uniform, peanut-shell-sized shapes, but could be either uniform or non-uniform and of varying size and/or shape.

Rotating molder structure 34 rotates between fixed end plates 40 which have sections along which different functions occur to molds 16 when in such positions. More specifically, when a mold 16 is in the lower loading position 42 it is exposed to slurry fed from pulper 32 and its cavities 18 are loaded as vacuum draws slurry toward screen 38. Vacuum is applied through all the apertures 44 illustrated in FIG. 6. Wet pulp fibers collect on screen 38 during such loading step.

As molder structure 34 rotates such that mold 16 moves along drying position 46, vacuum application continues, but now for the purpose of beginning a partial drying process by drawing air through the damp pulp collected on screen 38. Such vacuum application for partial drying utilizes apertures 44, as did the vacuum loading step; the air for drying is drawn through the damp pulp, then screen 38, and finally apertures 44.

Figure 7:
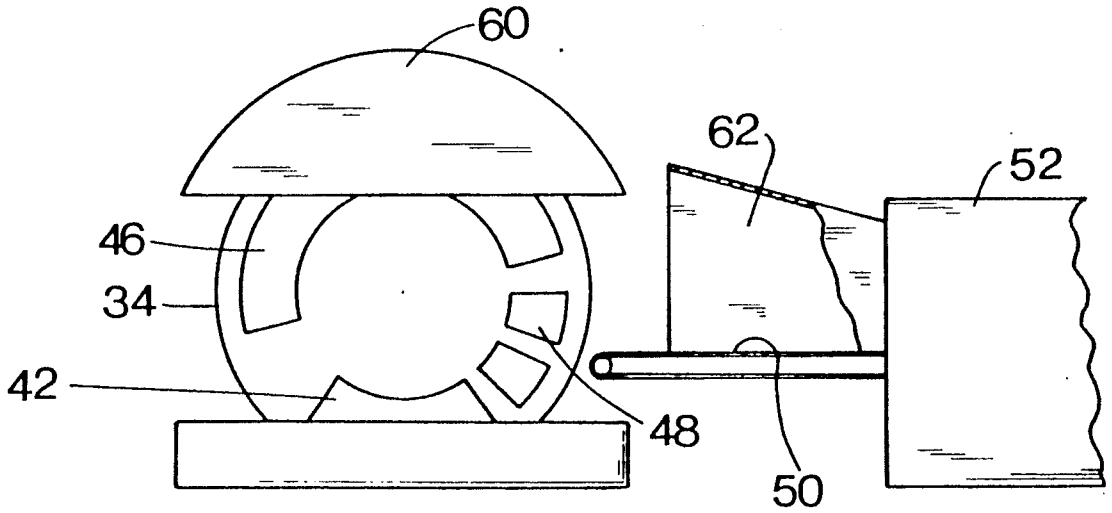
FIG. 7 is a partially schematic, partially cutaway, fragmentary side elevation of the apparatus of FIG. 5, including certain portions (a heating unit and a hood) not shown in FIG. 5.

As shown in FIG. 7, heating unit 60 extends over and around the top portion of rotating molder structure 20 34 adjacent to screen 38. Heating unit 60 is a source of heated air, preferably at about 150°–450° F., which is drawn through the damp pulp fibers as just described. This accelerates partial drying to facilitate formation of the still-moist intermediate pieces, making them ready for subsequent processing.

When molder structure 34 has rotated sufficiently, partially-dried intermediate pieces are formed and remain on their respective screens 38. When mold 16 reaches removal position 48, compressed air is blown through apertures 44*a–c*, in a direction opposite to flow during application of vacuum. Such compressed air flow through screen 38 blows the partially-dried (intermediate) dunnage pieces from cavities 18 and away from mold 16.

The final random shapes of dunnage pieces 10 are influenced by the form-free manner in which the moisture-laden intermediate pieces are removed from cavities 18. Each of such intermediate pieces is blown from its cavity 18 and lands by gravity on a conveyor 50 which carries it, with many other intermediate pieces, to drier ovens 52 and 54 for final drying. As shown in FIG. 7, a hood 62 surrounds the entry portion of conveyor 50 to help assure that all of the intermediate pieces land on conveyor 50.

Figure 1:
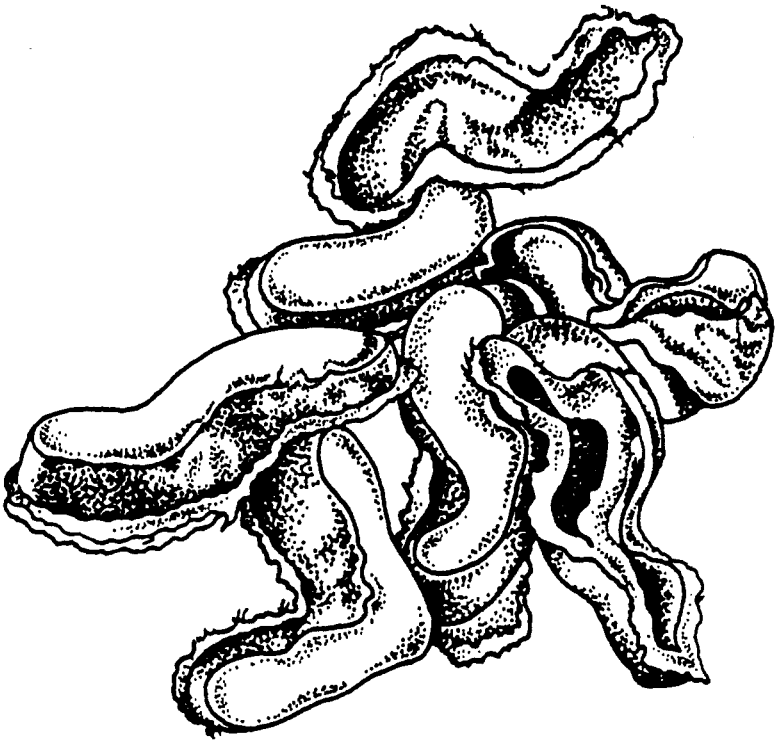
FIG. 1 is a perspective view of free-flowing molded pulp dunnage pieces grouped together, such pieces having been made using the method and apparatus of this invention.

As already noted, such removal of the intermediate pieces from cavities 18 by blowing is without use of any transfer die or any other sort of form support. Such blowing of the still moisture-laden intermediate pieces and their landing on conveyor 50 tend to alter the shapes of the intermediate pieces and causes even greater randomness in the final shapes of the dunnage pieces. During the final drying steps, which occur without any form support whatsoever for the intermediate dunnage pieces, the pieces assume their own unique and random shapes, such as those illustrated in FIGS. 1 and 2. The randomness of dunnage pieces 10 is randomness in the shapes of the voids defined by such dish-shaped pieces and randomness in the shapes of edges 14.

After mold 16 passes conveyor 50, it then passes a washing portion 58 where it is prepared to again accept pulp from the slurry.

The nature of edges 14 of dunnage pieces 10, that is, the extent to which their edges 14 are beaded, may be controlled in part by spraying screens 38 with water shortly after they emerge from the slurry with damp pulp fibers captured in cavities 18. Excess pulp fiber gathered along rim portions 56 of cavities 18 and extending beyond the screen portions of cavities 18 can be washed off by such spraying, leaving less material for beading.

While the principles of this invention have been described in connection with specific embodiments, it should be understood that these descriptions are made only by way of example and are not intended to limit the scope of the invention.

I claim:

1. A method for manufacture of a free-flowing dunnage comprising:

mixing pulp fibers with water to form a water-based pulp-stock slurry;

capturing damp pulp fibers from the slurry onto a dish-shaped screen;

partially drying the pulp fibers on the screen to form individual dish-shaped intermediate pieces;

form-free removing of the partially-dried intermediate pieces from the screen; and thereafter drying the intermediate pieces free of form support;

thereby to form random dish-shaped dunnage pieces which resist nesting with each other.

2. The method of claim 1 wherein the pulp fibers are derived from recycled pulp.

3. The method of claim 2 wherein the recycled pulp is newsprint.

4. The method of claim 1 wherein the intermediate pieces are removed from the screen by blowing the intermediate pieces from the screen.

5. The method of claim 4 wherein the blowing causes the intermediate pieces to land on a conveyor for movement to final drying, the blowing and landing altering the shapes of the intermediate pieces thereby to enhance randomness in the shapes of the dunnage pieces.

6. The method of claim 5 wherein the intermediate pieces blown from the screen fall by gravity onto the conveyor.

7. The method of claim 5 wherein:

the screen overlies a backing plate which with the screen determines shapes of the intermediate pieces; and the backing plate has a plurality of apertures through which such blowing occurs to remove the intermediate pieces.

8. The method of claim 7 wherein the fibers are partially dried on the screen by means of air drawn by vacuum through the damp pulp fibers, the screen, and the apertures, the apertures being used both for partial drying and for removal by blowing.

9. The method of claim 8 wherein the partial drying step further includes providing a source of heated air adjacent to the screen, drawing such heated air through the damp pulp fibers, the screen, and the apertures.

10. The method of claim 1 wherein the partial drying step includes heating the damp pulp fibers while on the screen.

11. A method for manufacture of a free-flowing dunnage comprising:

mixing pulp fibers with water to form a water-based pulp-stock slurry;

capturing damp pulp fibers from the slurry onto a screen;

partially drying the pulp fibers on the screen to form individual dish-shaped intermediate pieces;

blowing the partially-dried intermediate pieces from the screen to cause the intermediate pieces to land on a conveyor for movement to final drying, the blowing and landing altering the shapes of the intermediate pieces; and thereafter drying the intermediate pieces free of form support; thereby to form random dish-shaped dunnage pieces which resist nesting with each other.

12. The method of claim 11 wherein the pulp fibers are derived from recycled pulp.

13. The method of claim 12 wherein the recycled pulp is newsprint.

14. The method of claim 11 wherein the intermediate pieces blown from the screen fall by gravity onto the conveyor.

15. The method of claim 14 wherein:

the screen overlies a backing plate which with the screen determines shapes of the intermediate pieces; and the backing plate has a plurality of apertures through which such blowing occurs to remove the intermediate pieces.

16. The method of claim 15 wherein the fibers are partially dried on the screen by means of air drawn by vacuum through the damp pulp fibers, the screen, and the apertures, the apertures being used both for partial drying and for removal by blowing.

17. The method of claim 16 wherein the partial drying step further includes providing a source of heated air adjacent to the screen, drawing such heated air through the damp pulp fibers, the screen, and the apertures.

18. The method of claim 11 wherein the partial drying step includes heating the damp pulp fibers while on the screen.

* * * * *

UNITED STATES PATENT AND TRADEMARK OFFICE

CERTIFICATE OF CORRECTION

PATENT NO. : 5,328,568

DATED : July 12, 1994

INVENTOR(S) : Jack E. Pregont

It is certified that error appears in the above-indentified patent and that said Letters Patent is hereby corrected as shown below:

Column 1, line 10, delete "Dec. 22, 1993" and insert —July 27, 1993—.

Column 7, line 62, delete "20".

Signed and Sealed this

Twenty-seventh Day of September, 1994

*Attest:*

BRUCE LEHMAN

*Attesting Officer*

*Commissioner of Patents and Trademarks*